United States Patent [19]

Morel et al.

[11] Patent Number: 4,890,771

[45] Date of Patent: Jan. 2, 1990

[54] CARTRIDGE FOR INJECTING A MIXTURE OF TWO LIQUID CONSTITUENTS

[75] Inventors: Jacques Morel, Fontaine Les Ribouts; Didier Morel, Favieres, both of France

[73] Assignee: Etablissements Morel - Ateliers Electromecaniques De Favieres, Chateauneuf-en-Thymerais, France

[21] Appl. No.: 226,950

[22] Filed: Aug. 1, 1988

[30] Foreign Application Priority Data

Jul. 31, 1987 [FR] France ..... 87 10932

[51] Int. Cl.[4] ..... B67D 5/52

[52] U.S. Cl. ..... 222/137; 401/175

[58] Field of Search ..... 222/137, 135, 136, 129, 222/145, 411, 326, 327; 401/174, 175

[56] References Cited

U.S. PATENT DOCUMENTS

| | | | |
|---|---|---|---|
| 2,826,339 | 3/1958 | Maillard | 222/137 |
| 4,046,288 | 9/1977 | Bergman | 222/135 |
| 4,366,919 | 1/1983 | Anderson | 222/137 |
| 4,432,469 | 2/1984 | Eble et al. | 222/137 |
| 4,526,295 | 7/1985 | Morel et al. | 222/137 |
| 4,538,920 | 9/1985 | Drake | 222/137 |

*Primary Examiner*—F. J. Bartuska
*Assistant Examiner*—Kenneth Noland
*Attorney, Agent, or Firm*—Young & Thompson

[57] ABSTRACT

A cartridge for injecting a mixture of two liquid constituents comprising a reservoir (1) which has a compartment (2) for one of the constituents and a compartment (3) for the other constituent. The reservoir (1) comprises two concentric cylindrical compartments (2, 3), respectively containing a first and a second constituent. A piston (6, 7) is mounted in sliding manner in each of the two compartments (2, 3), and provision is made for sliding the two pistons (6, 7) simultaneously. Each of the compartments (2, 3) opens into a common mixing chamber (4) which comprises partitions (8, 9) defining a sinuous path of the mixture of the two constituents between the two compartments (2, 3) and the outlet opening (5) of the mixing chamber (4). Use, in particular, for injecting a semi-pasty sealing material into a hollow body.

11 Claims, 3 Drawing Sheets

CARTRIDGE FOR INJECTING A MIXTURE OF TWO LIQUID CONSTITUENTS

The present invention relates to a cartridge for injecting into a hollow body a semi-pasty product, such as a polyurethane foam, obtained by mixing two liquid constituents, namely a polyol and an isocyanate.

The cartridge proposed by the invention is intended, in particular, for injecting polyurethane foam into a sleeve providing sealing and electrical insulation and surrounding the splice which connects electrical or electronic cables.

French Patent No. 2,518,450, belonging to the Applicant, discloses a cartridge for injecting into a hollow body a semi-pasty product obtained by mixing two liquid constituents, comprising two receptacles mounted inside one another in sliding manner and each containing one of the two abovementioned constituents. One of the receptacles is separated from the other receptacle by a partition and the other receptacle has an outlet joining piece intended to be connected to the injection orifice of the hollow body, this partition and this outlet joining piece each having a protective cover which can be perforated by a perforator rod mounted axially in the cartridge, in order to allow the passing of the constituents of the first receptacle into the second receptacle and the passing of the resulting mixture through the outlet joining piece of the second receptacle, respectively. The rod has a smooth front part and a thread:d rear part, which are separated by a short, threaded intermediate part which has a diameter greater than that of the said front and rear parts. The first receptacle has, at its end opposite the second receptacle, a tapped opening intended to receive the said threaded intermediate part. The free end of the smooth part of the rod is threaded. The outlet joining piece of the second receptacle has an internal tap intended to receive the thread made at the end of this smooth part. The length of this smooth part is greater than the distance between the partition and the tap of the first receptacle and the threaded part of the rod has a nut intended to bear outside the cartridge against the end of the first receptacle, to push the latter into the second receptacle.

The disadvantages of the abovementioned known cartridge consist in the fact that it does not allow a perfect mixture of the two constituents to be obtained and that it can lead to poor results when it is not used correctly.

The object of the present invention is to overcome the disadvantages of the abovementioned construction by proposing an injection cartridge which makes it possible to obtain a perfect mixture of the two constituents and whose operation and use are at once simple, easy, safe and reliable.

The cartridge proposed by the invention for injecting a mixture of two liquid constituents comprises a reservoir which has a compartment for one of the constituents and a compartment for the other constituent and means for propelling these constituents toward a mixing chamber which opens to the outside by way of an outlet opening. The reservoir comprises two concentric cylindrical compartments respectively containing the first and second constituent, a piston being mounted in sliding manner in each of the two compartments: the two pistons comprise an annular piston mounted in the exterior compartment, of complementary annular section, this annular piston surrounding the second piston, which is mounted in the interior cylindrical compartment, which is surrounded by the exterior compartment, these two pistons being connected to one another such that it is possible to slide them simultaneously.

According to the invention, this cartridge is defined in that the annular piston is carried by a tube of which the diameter is greater than the diameter of the interior compartment, in that the second piston is carried by a tube of which the diameter is smaller than the diameter of the interior compartment, in that the ends of these two tubes opposite the pistons are connected to one another, in that, inside the tube carrying the second piston, there is mounted a screw which is screwed into a nut which is secured to the two ends of the tubes opposite the pistons, in that this screw comprises an element which is capable of bearing against a stop located beyond the nut, this stop being secured to a body which is connected to the end of the reservoir which is adjacent to the annular piston, means being provided to slide the two pistons simultaneously, and in that each of the compartments opens into a common mixing chamber which comprises partitions defining a sinuous path of the mixture of the two constituents between the two compartments and the outlet opening of the mixing chamber.

During use, the two pistons sliding in the two compartments simultaneously propel the two constituents into the mixing chamber. Because these two constituents, in the mixing chamber, assume sinuous paths defined by deflecting partitions, these two constituents emerge at the outlet of the chamber in the form of a perfectly homogeneous mixture.

In an advantageous embodiment of the invention, the reservoir is extended opposite the pistons by a sleeve into which the mixing chamber is screwed, and the part of this chamber adjacent to the two compartments comprises a central opening which is capable of communicating with an orifice of the interior compartment and one or more peripheral openings which are capable of communicating with one or more peripheral orifices of the exterior compartment, after unscrewing the mixing chamber.

Thus, all that needs to be done to enable the two constituents coming from the reservoir to penetrate into this chamber, where these two constituents are automatically mixed before being expelled to the outside, is to unscrew the mixing chamber.

Other details and advantages of the invention will also become apparent in the description below.

In the attached drawings, which are given by way of non-limiting example:

Figure 1:
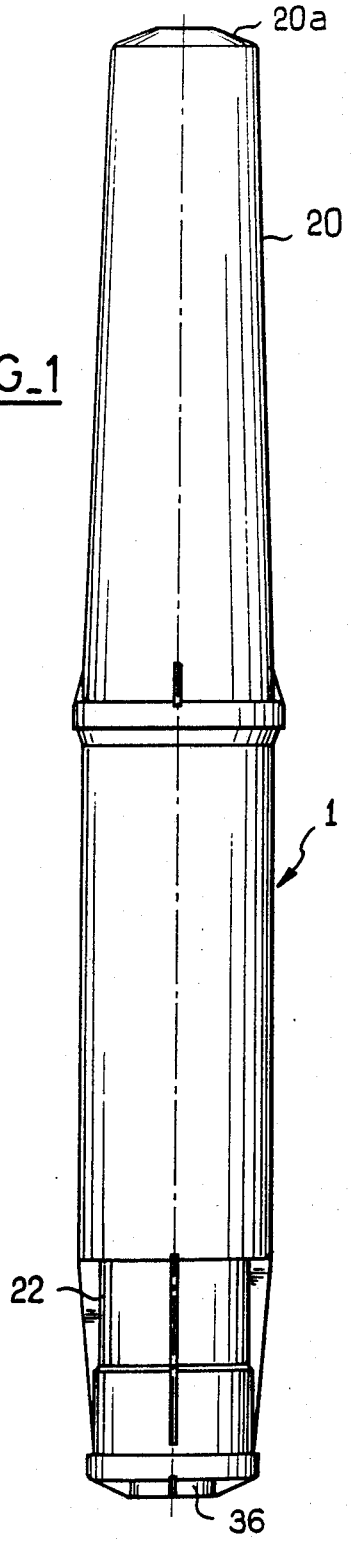
FIG. 1 is a plan view of the cartridge in accordance with the invention.
Figure 2:
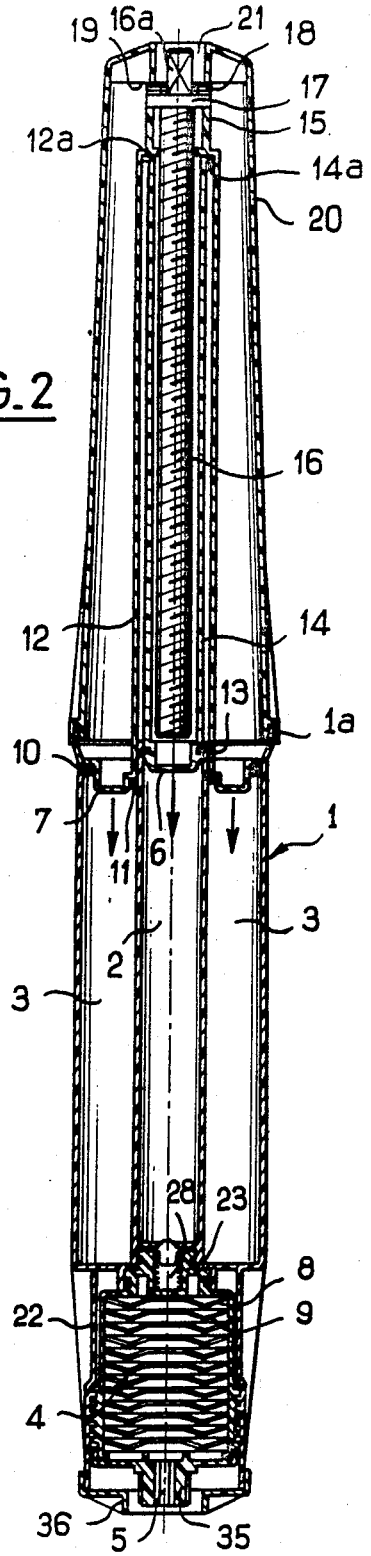
FIG. 2 is a cross-sectional view of the cartridge.

In the embodiment of FIGS. 1 and 2, the cartridge, which is constructed entirely in a plastics material, for injecting into a hollow body a mixture of two liquid constituents comprises a reservoir 1 which has a compartment 2 for one of the constituents and a compartment 3 for the other constituent and means, which will be specified below, for propelling these two constituents toward a mixing chamber 4 which opens to the outside by way of an outlet opening 5. The reservoir 1 comprises two concentric cylindrical compartments 2, 3 which respectively contain the first and the second constituent. A piston 6, 7 is mounted in sliding manner in each of the two compartments 2, 3. Means are provided to slide the two pistons 6, 7, simultaneously. Each of the compartments 2, 3 opens into the common mixing chamber 4. The latter comprises a series of partitions, such as 8, 9, defining a sinuous path of a mixture of the two constituents between the two compartments 2, 3 and the outlet opening 5 of the mixing chamber 4.

The two pistons comprise an annular piston 7 mounted in the exterior compartment 3 of complementary annular section. This annular piston 7 surrounds the second piston 6, which is mounted in the interior cylindrical compartment 2, which is itself surrounded by the exterior compartment 3. These two pistons 6, 7 are connected to one another such that it is possible to slide them simultaneously.

The annular piston 7, which is provided with seals 10, 11, is carried by a tube 12 of which the diameter is greater than the diameter of the interior compartment 2. The second piston 6, which is provided with a seal 13, is carried by a tube 14 of which the diameter is smaller than the diameter of the interior compartment 2. The ends 12*a*, 14*a* of these two tubes 12, 14 opposite the pistons 6, 7 are connected to one another by a sleeve 15.

Inside the tube 14 carrying the second piston 6, there is mounted a screw 16 which is screwed into a nut 17 which is secured to the two ends 12*a*, 14*a* of the tubes 12, 14. This screw 16 comprises an element 18 which is capable of bearing against a stop 19 located beyond the nut 17. This stop 19 is secured to a body 20 which is connected to the end 1*a* of the reservoir 1 adjacent to the annular piston 7.

It can be seen from FIG. 1 that the body 20 surrounds and covers in sealed manner the tubes 12, 14 of the pistons 7, 6 and the screw 16.

Furthermore, the body 20 comprises at its end 20*a* opposite the reservoir 1 a recess 21, in which there projects a joining piece 16*a* of the screw 16, this joining piece 16*a* being intended to receive an element such as a wrench for driving this screw in rotation.

Moreover, the reservoir 1 is extended opposite the pistons 6, 7 by a sleeve 22 (see also FIGS. 3 and 4), into which the mixing chamber 4 is screwed. The part 23 of this chamber 4 adjacent to the two compartments 2, 3 comprises a central opening 24 which is capable of communicating with an orifice 31 of the interior compartment 2 and several peripheral openings 26 which are capable of communicating with one or more peripheral orifices 27 of the exterior compartment 3, after unscrewing the mixing chamber (see FIGS. 4 and 5). The part 23 of the mixing chamber 4 comprises (see FIG. 3) a shoulder 25 located between two joints which closes in sealed manner the orifices 27 of the exterior compartment, when the mixing chamber 4 is screwed as far as it will go into the sleeve 22.

Furthermore, the part 23 of the mixing chamber 4 comprises a cavity 28 of which the base has an opening 24 communicating with the interior of the chamber and in which there is mounted a valve 29 bearing, under the action of a spring 30, against an orifice 31 in the base of the central compartment 2.

The force with which the valve 29 bears against the orifice 31 and the cross section of the latter are determined such that, when the pistons 6, 7 are pushed towards the mixing chamber 4, the rate at which the constituent passes through the orifice 31 is proportional to the rate at which the other constituent passes through the peripheral orifices 27, taking into account the desired mixture of these two constituents.

Figure 3:
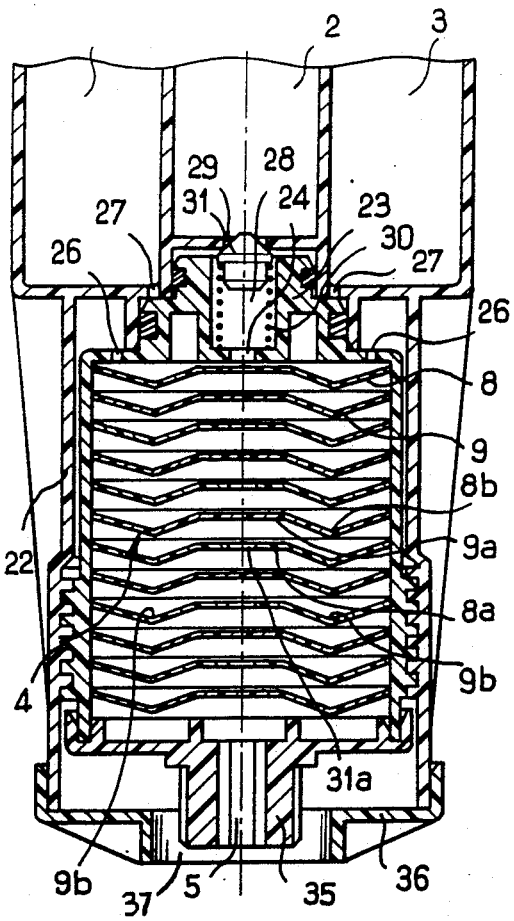
FIG. 3 is a view on a larger scale, in crosssection, of the end of the cartridge which has the mixing chamber.
Figure 4:
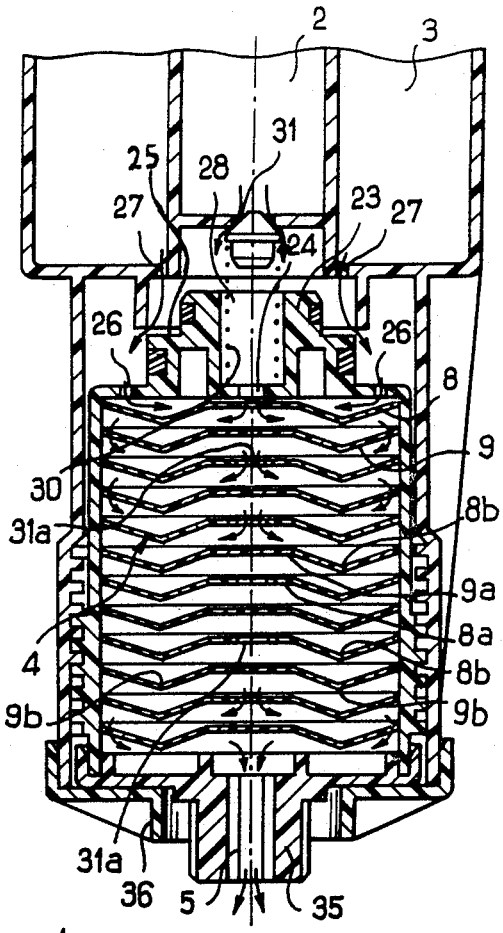
FIG. 4 is a view similar to FIG. 3, showing the mixing chamber in the unscrewed operating condition.
Figure 5:
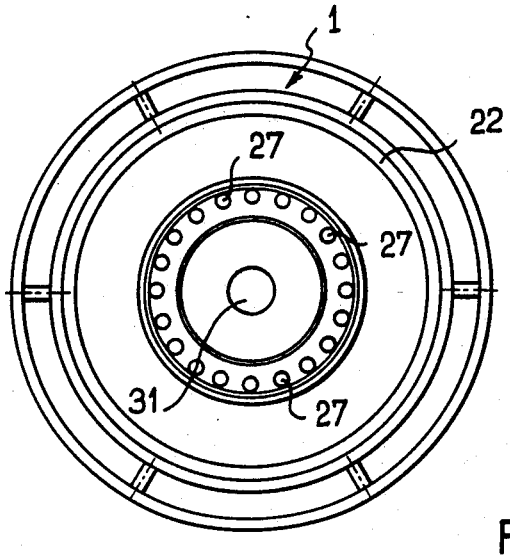
FIG. 5 is an end view of the cartridge, its end cap and its mixing chamber being removed.
Figure 7:
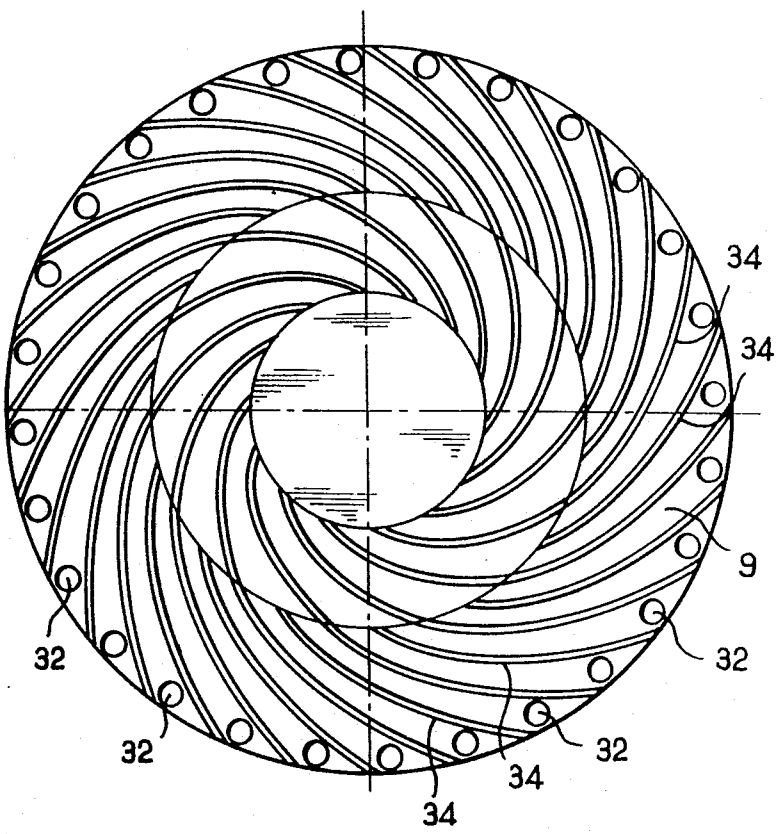
FIG. 7 is a plan view of another disk of the mixing chamber.
Figure 6:
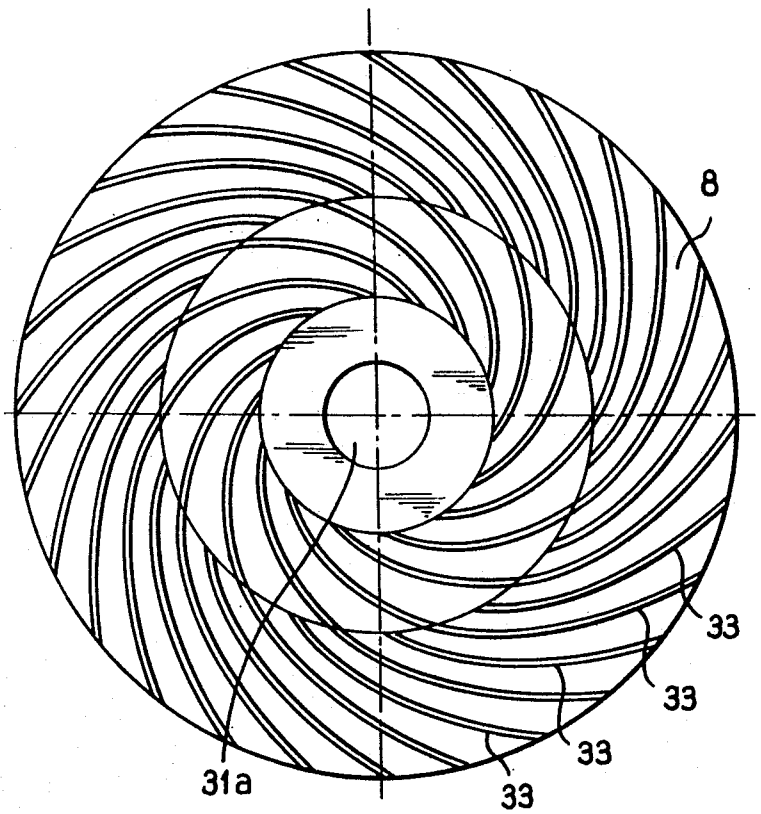
FIG. 6 is a plan view of a disk of the mixing chamber.

It can also be seen from FIGS. 3 and 4 that the partitions, such as 8, 9, of the mixing chamber 4 are composed of parallel disks extending over the entire chamber 4 in the dimension which is perpendicular to the axis of the reservoir 1. These disks 8, 9 alternately have a central opening 31*a* (see FIG. 6) and a series of peripheral openings 32 (see FIG. 7) of smaller dimensions than the central opening 31*a*, these openings 31*a*, 32 compelling the mixture of the two constituents to assume a sinuous path (see arrows in FIG. 4).

Moreover, each disk 8, 9 has on its two faces a series of ribs 33, 34 in the shape of a spiral arc, extending between the central part of the disks 8, 9 and the periphery of the latter and becoming progressively further apart.

It can also be seen from FIGS. 3 and 4 that the cross section of the disks 8, 9 has a central plane part 8*a*, 9*a* extended on either side toward the outside by two V-shaped parts 8*b*, 9*b*.

The outlet 5 of the mixing chamber 4 is made in a joining piece 35 which can be screwed into an injection connection piece (not shown). Screwing and unscrewing the mixing chamber 4 with respect to the reservoir 1 is carried out by rotating the latter with respect to the injection connection piece.

Moreover, the sleeve 22 into which the mixing chamber 4 is screwed is closed at its end opposite the reservoir 1 by a cap 36 which protects the chamber and is provided with a central opening 37. This cap 36 constitutes a stop for limiting the travel when the chamber 4 is unscrewed (see FIG. 4).

Moreover, the direction of thread in which the mixing chamber 4 is screwed is opposite that of the thread of the screw 16 for actuating the pistons 6, 7.

The operation of the cartridge which has been described is as follows.

During storage of the cartridge, the latter is in the position shown in FIGS. 2 and 3. The compartments 2 and 3 of the reservoir 1 are closed on one side by the pistons 6 and 7 and the other side by the mixing chamber 4 which is screwed as far as it can go against the end of the reservoir 1.

When the cartridge is used, there is nothing to cut or to open. All that needs to be done is to screw the threaded joining piece 35 of the mixing chamber as far as it can go onto the injection connection piece fastened to the hollow body which is to be filled.

Rotation of the cartridge with respect to the connection piece is then continued. The reverse pitch (left-hand) thread according to which the mixing chamber 4 is screwed into the sleeve 22 causes this mixing chamber 4 to be unscrewed, which releases the orifices and openings for communication between the compartments 2 and 3 and the mixing chamber 4.

All that is then required is to turn the screw 16, engaging an appropriate wrench onto the joining piece 16*a* of this screw. Given that the thread of this screw 16 is the opposite to that of the mixing chamber 4, there is no risk of the latter being screwed towards the reservoir 1 when the screw 16 is rotated.

Rotation of this screw 16 drives the synchronous sliding of the pistons 6 and 7, which causes the two constituents to be expelled into the mixing chamber 4.

By passing successively through the central opening 31*a* of a disk 8 towards the small openings 32 of the following disk 9, the two constituents describe a sinuous path, which enables a perfectly homogeneous mixture of these two constituents to be obtained.

The obtaining of an excellent mixture also results from the fact that the constituents flow in a multitude of channels delimited by the ribs 33, 34 in a spiral arc, which have the effect of dividing the material.

Of course, the invention is not limited to the exemplary embodiment which has been described, and numerous modifications can be applied to the latter without departing from the scope of the invention.

Thus, the shape and number of the disks 8, 9 contained in the mixing chamber could be different from those described, provided that the constituents follow a sinuous path in this chamber.

I claim:

1. A cartridge for injecting a mixture of two liquid constituents, comprising a reservoir (1) which has a compartment (2) for one of the constituents and a compartment (3) for the other constituent and means for propelling these two constituents toward a mixing chamber (4) which opens to the outside by way of an outlet opening (5), the reservoir (1) comprising two concentric cylindrical compartments (2, 3), respectively containing the first and the second constituent, a piston (6, 7) being mounted in sliding manner in each of the two compartments (2, 3), the two pistons (6, 7) comprise an annular piston (7) mounted in the exterior compartment (3), of complementary annular section, this annular piston (7) surrounding the second piston (6), which is mounted in the interior cylindrical compartment (2), which is surrounded by the exterior compartment, these two pistons (6, 7) being connected to one another such that it is possible to slide them simultaneously, wherein the annular piston (7) is carried by a tube (12) of which the diameter is greater than the diameter of the interior compartment (2), wherein the second piston (6) is carried by a tube (14) of which the diameter is smaller than the diameter of the interior compartment (2), wherein the ends of these two tubes (12, 14) opposite the pistons (6, 7) are connected to one another, wherein, inside the tube (14) carrying the second piston (6), there is mounted a screw (16) which is screwed into a nut (17) which is secured to the two ends (12*a*, 14*a*) of the tubes (12, 14) opposite the pistons, wherein this screw (16) comprises an element (18) which is capable of bearing against a stop (19) located beyond the nut (17), this stop (19) being secured to a body (20) which is connected to the end (1*a*) of the reservoir (1) which is adjacent to the annular piston (7), means being provided to slide the two pistons (6, 7) simultaneously, and wherein each of the compartments (2, 3) opens into a common mixing chamber (4) which comprises partitions (8, 9) defining a sinuous path of the mixture of the two constituents between the two compartments (2, 3) and the outlet opening (5) of the mixing chamber (4), the body (20) surrounding and covering in sealed manner the tubes (12, 14) of the pistons and the screw (16).

2. A cartridge as claimed in claim 1, wherein the body (20) comprises at its end (20*a*) opposite the reservoir (1) a recess (21), in which there projects a joining piece (16*a* ) of the screw (16), this joining piece (16*a* ) being intended to receive an element for driving this screw (16) in rotation.

3. A cartridge as claimed in claim 1, wherein the reservoir (1) is extended opposite the pistons (6, 7) by a sleeve (22) into which the mixing chamber (4) is screwed, and wherein the part (23) of this chamber (4) adjacent to the two compartments (2, 3) comprises a central opening (24) which is capable of communicating with an orifice (31) of the interior compartment (2) and one or more peripheral openings (26) which are capable of communicating with one or more peripheral orifices (27) of the exterior compartment (3), after unscrewing the mixing chamber (4).

4. A cartridge as claimed in claim 3, wherein the said part (23) of the mixing chamber (4) comprises a shoulder (25) which closes in sealed manner the orifices (27) of the exterior compartment, when the mixing chamber (4) is screwed as far as it will go into the sleeve (22) and wherein the said part (23) of the mixing chamber (4) comprises a cavity (28) of which the base has an opening (24) communicating with the interior of the chamber (4) and in which there is mounted a valve (29) bearing, under the action of a spring (30), against the orifice (31) of the central compartment (2).

5. A cartridge as claimed in claim 4, wherein the force with which the valve (29) bears against the orifice (31) and the cross section of the latter are determined such that, when the pistons (6, 7) are pushed towards the mixing chamber (4), the rate at which the constituent passes through the orifice (31) is proportional to the rate at which the other constituent passes through the peripheral orifices (27) taking into account the desired mixture of these two constituents 6. A cartridge as claimed in claim 3, wherein the sleeve (22) into which the mixing chamber (4) is screwed is closed at its end opposite the reservoir (1) by a cap (36), this cap (36) constituting a stop for limiting the travel when the chamber (4) is unscrewed.

7. A cartridge as claimed in claim 3, wherein the direction of the thread onto which the mixing chamber (4) is screwed is opposite that of the thread of the screw (16) for actuating the pistons (6, 7).

8. A cartridge as claimed in claim 1, wherein the partitions (8, 9) of the mixing chamber (4) are composed of parallel disks extending over the entire chamber in the dimension which is perpendicular to the axis of the reservoir (1), these disks (8, 9) alternately having a central opening (31*a*) and a series of peripheral openings (32) of smaller dimensions than this central opening (31*a*), these openings (31*a*), (32) compelling the mixture of the two constituents to assume a sinuous path.

9. A cartridge as claimed in claim 8, wherein each disk (8, 9) has on its two faces a series of ribs (33, 34) in the shape of a spiral arc, extending between the central part of the disk (8, 9) and the periphery of the latter and becoming progressively further apart.

10. A cartridge as claimed in claim 9, wherein the cross section of the disks (8, 9) has a central plane part (8*a*, 9*a*) extended on either side toward the outside by two V-shaped parts (8*b*, 9*b*).

11. A cartridge as claimed in claim 1, wherein the outlet (5) of the mixing chamber (4) is made in a joining piece (35) which can be engaged in an injection connection piece, screwing and unscrewing the mixing chamber (4) with respect to the reservoir (1) being carried out by rotating the latter with respect to the injection connection piece.

* * * * *